US005617102A

United States Patent [19]

Prater

[11] Patent Number: 5,617,102

[45] Date of Patent: Apr. 1, 1997

[54] COMMUNICATIONS TRANSCEIVER USING AN ADAPTIVE DIRECTIONAL ANTENNA

[75] Inventor: James S. Prater, Fort Collins, Colo.

[73] Assignees: AT&T Global Information Solutions Company, Dayton, Ohio; Hyundai Electronics America, San Jose, Calif.; Symbios Logic Inc., Fort Collins, Colo.

[21] Appl. No.: 342,328

[22] Filed: Nov. 18, 1994

[51] Int. Cl.[6] ..... H01Q 3/02

[52] U.S. Cl. ..... 342/374; 342/432; 342/434

[58] Field of Search ..... 342/374, 432, 342/435, 433, 434

[56] References Cited

U.S. PATENT DOCUMENTS

| | | | |
|---|---|---|---|
| 3,357,018 | 12/1967 | Villard, Jr. | 343/100 |
| 3,737,899 | 6/1973 | Georgopoulos | 343/5 R |
| 4,032,922 | 6/1977 | Provencher | 343/854 |
| 4,103,302 | 7/1978 | Roeder et al. | 343/9 |
| 4,298,873 | 11/1981 | Roberts | 343/100 SA |
| 4,378,559 | 3/1983 | Rittenbach | 343/854 |
| 4,538,153 | 8/1985 | Taga | 343/700 |
| 4,710,944 | 12/1987 | Nossen | 375/40 |
| 4,779,138 | 10/1988 | Nomura et al. | 358/236 |
| 4,845,507 | 7/1989 | Archer et al. | 343/754 |
| 4,972,457 | 11/1990 | O'Sullivan | 379/59 |
| 4,973,952 | 11/1990 | Malec et al. | 340/825.35 |
| 4,992,799 | 2/1991 | Garay | 343/702 |
| 5,117,236 | 5/1992 | Chang et al. | 342/367 |
| 5,189,632 | 2/1993 | Paajanen et al. | 364/705.05 |
| 5,194,873 | 3/1993 | Sickles | 342/374 |
| 5,260,968 | 11/1993 | Gardner et al. | 375/1 |
| 5,281,962 | 1/1994 | Vanden Heuvel et al. | 340/825.44 |
| 5,305,181 | 4/1994 | Schultz | 361/680 |
| 5,307,297 | 4/1994 | Iguchi et al. | 364/708.1 |
| 5,329,531 | 7/1994 | Diepstraten et al. | 370/94.2 |

FOREIGN PATENT DOCUMENTS

| | | |
|---|---|---|
| 0124319 | 11/1984 | European Pat. Off. . |
| 0352787 | 1/1990 | European Pat. Off. . |
| 2512611 | 9/1982 | France . |
| 3210830 | 9/1991 | Japan . |
| 4320122 | 11/1992 | Japan . |

*Primary Examiner*—Thomas H. Tarcza
*Assistant Examiner*—Dao L. Phan
*Attorney, Agent, or Firm*—David K. Lucente; Wayne P. Bailey

[57] ABSTRACT

A directional antenna connected to a portable communications transceiver is adaptively directed towards a remote station in a communication system. The amount of RF power required by the portable device is significantly reduced, relative to a non-directional antenna. The operational period of the transceiver between battery recharges is therefore considerably maximized.

26 Claims, 5 Drawing Sheets

COMMUNICATIONS TRANSCEIVER USING AN ADAPTIVE DIRECTIONAL ANTENNA

BACKGROUND OF THE INVENTION

1. Field of the Invention

The present invention relates to a system for communications within a network, and more specifically to a system which uses an adaptive antenna pattern technology to provide improved signal directionality to reduce the power required for communication by a mobile or remote transceiver.

2. Description of Related Art

U.S. Pat No. 5,260,968 to Gardner et al. discloses a method for "multiplexing radio communication signals," and uses "blind adaptive spatial filtering of spectrally overlapping signals." This method employs "self [spectral] coherence restoral" techniques which require complicated digital signal processing apparatus to provide the autocorrelation functions necessary to implement the method. Gardener's "adaptive" antenna array is situated at the base station, rather than at the mobile site.

U.S. Pat No. 4,298,873 to Roberts discloses an adaptive antenna which steers toward nulls on an interference source. It should be noted that the method of the present invention teaches away from the method of Roberts by seeking signal maximums in a received signal. Furthermore, Roberts' method requires relatively complex hardware to implement the delay line adjustment and amplitude balance necessary for operation of his "null antenna processor."

Furthermore, none of the prior cellular communications devices employs an adaptive directional multiple-monopole antenna system.

SUMMARY OF THE INVENTION

In accordance with each of a plurality of embodiments of the present invention, a system is provided which reduces the power consumption of a cellular phone or other similar remote transceiver. In each of these embodiments an adaptive directional antenna is used to radiate RF power in the direction of the cellular phone (or other) base station instead of radiating the RF power omnidirectionally. The directionality of the antenna is useful for reception as well as transmission, because it increases the strength of the received signal and reduces the amount of noise picked up by the cellular transceiver. The present system is particularly well suited to portable computing applications, such as those using a laptop computer or other remote computing device such as a "personal digital assistant".

One exemplary embodiment of the present system includes a simple adaptive antenna system which can be switched, either manually or via microprocessor, to direct the radiated RF energy into, for example, quadrants or hemispheres in the vicinity of a communicating base station or satellite. This system saves transceiver battery power and compensates for large changes in orientation of the mobile transceiver with respect to the base station/satellite while maximizing signal gain between the transceiver and the base station/satellite.

In a typical cellular phone system, a "handoff protocol" is used to transfer the communication link from one base station to another when the cellular phone (or other transceiver) signal passes from one cell to another cell in the cellular network. In a similar fashion, this same technique may be used to transfer the communication link from one orbitting satellite to another. An alternative embodiment of the present system changes the direction of the transceiver antenna direction to direct the antenna pattern toward the new base station/satellite when a handoff is made.

In yet another embodiment of the present system, the transfer of communications from one cell to another is accomplished via the handoff protocol itself, wherein the cellular phone adapts the antenna configuration whenever a handoff is detected via the communication received from the base station.

Another alternative embodiment of the present system periodically scans for the direction of the strongest return signal. Thus when a handoff is made, the cellular phone automatically adapts the antenna pattern at the next periodic direction scan.

Further additional embodiments of the present invention encompass a variety of directional antenna designs whose radiation patterns can be adapted by changing the phase of the feed signals to different antenna elements. Because space is typically limited in and around mobile computing devices, the antenna may be limited to two elements (for instance, two monopoles mounted on the ends of a notebook computer). Furthermore, since wide antenna pattern lobes are desirable, a simple two-monopole adaptive antenna is well suited to the present system.

A number of portable cellular devices are presently commercially available. Since all of these portable devices are typically battery powered, the operating period of each device is limited by the battery "life" available between successive recharges. Because the life of a given battery is extended by reducing the power consumption of the device is connected to the battery, it follows that reducing the power consumption of a battery powered cellular phone device is highly desirable.

In accordance with each one of a plurality of embodiments of the present invention, methods are provided for adapting an antenna pattern of a remote/mobile cellular transceiver to receive and transmit signals between a base station or satellite and the transceiver so as to establish an energy efficient communication path from the transceiver to the base station. The invention described herein is applicable to either base stations or satellites. The remaining description will describe the use of "base stations", however these techniques are similarly applicable to satellites as well.

Therefore, it is an object of the present invention to reduce the power consumption of a cellular phone or other similar transceiver to provide the advantage of extending the operating life of the transceiver battery.

The present system is particularly advantageous in that the reduction of transceiver power consumption requires only minimal hardware enhancements to existing cellular transceiver systems.

A further advantage of the present invention is that the system enhances the signal-to-noise (S/N) ratio of the signal transmitter well as the signal-to-noise ratio of the signals received (by the transceiver) from the base station.

BRIEF DESCRIPTION OF THE DRAWING

The invention may be better understood from a reading of the following description thereof taken in conjunction with the drawing in which.

DETAILED DESCRIPTION OF THE INVENTION

The present system uses a directional antenna connected to a portable cellular communications transceiver to adaptively direct the antenna pattern towards a base station in a cellular communication system. The term "cellular communications transceiver," as used in the present document, includes cellular telephones, 2-way pagers, wireless LANs, and mobile computers using a cellular communications network.

A number of portable cellular devices are presently commercially available. For example, PCMCIA ["PC Memory Card International Association"] cards are now available with cellular phone functions built in, and the EO PDA [Personal Digital Assistant] had a cellular phone option. Typical cellular phones, for example, use a single monopole antenna and radiate approximately 600 milliwatts of RF power in an omnidirectional pattern in a horizontal plane. A simple directional antenna can easily have a gain of approximately 3 dB over that of a monopole antenna. By replacing a single monopole with two monopoles, the radiated power can be reduced to 300 milliwatts, while maintaining the same power density in the direction of the base station.

Figure 6:
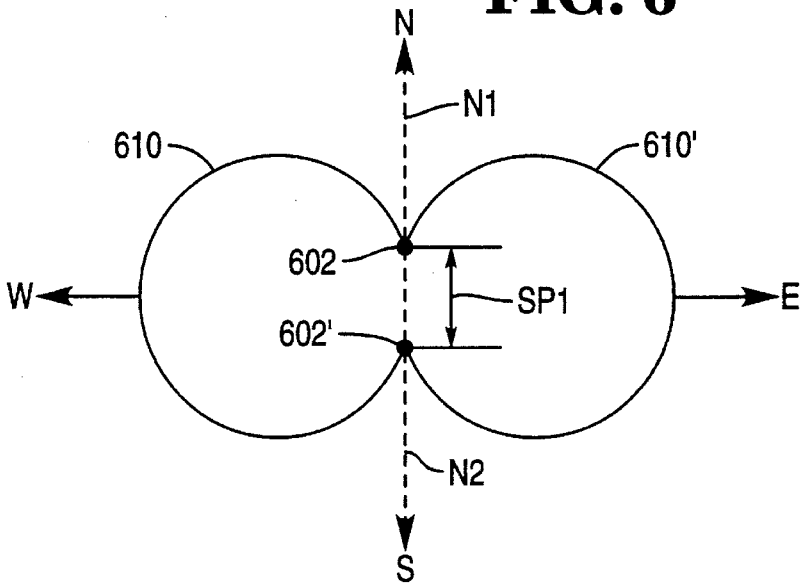
FIGS. 6 and 7 illustrate overhead views of alternative antenna patterns to which one version of the system may be adapted.
Figure 7:
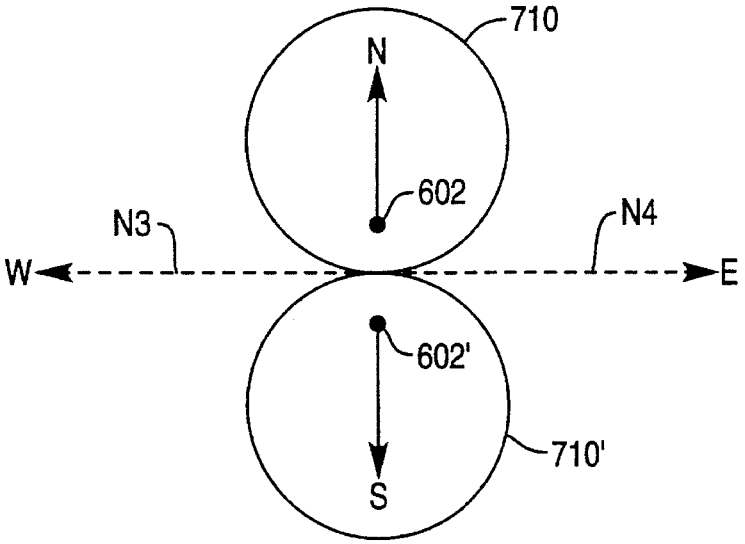
Figure 8:
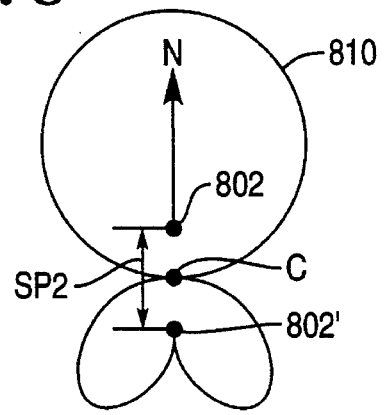
FIG. 8 shows an overhead view of a cardioid antenna pattern realizable with the present system.

Since a mobile transceiver changes orientation with respect to cellular phone base stations, if a directional antenna is employed, it must be made directionally adaptive to provide an optimum communications path. One exemplary embodiment of the present system includes a simple adaptive directional antenna system which can direct the RF energy into selected quadrants or hemispheres to allow large changes in orientation relative to a base station while minimizing signal loss. FIGS. 6–8, described in detail below, illustrate several possible antenna patterns which can be employed by the system to provide the required directionality.

Figure 1:
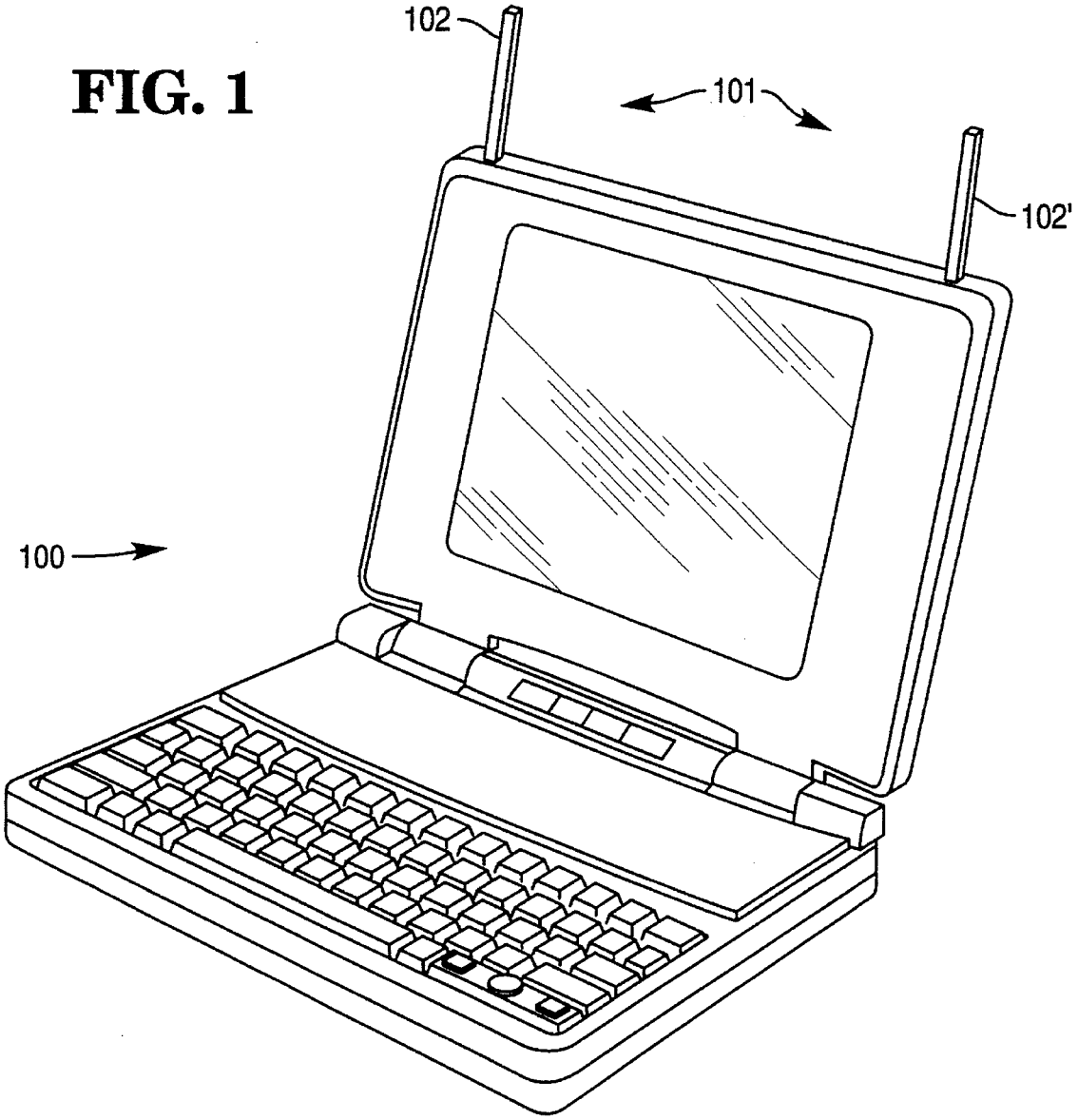
FIG. 1 shows an embodiment of the present system wherein two monopole antennas are mounted near the ends of a portable computer.

FIG. 1 shows an embodiment of the present system wherein antenna system 101 uses two monopole antennas 102, 102' mounted near the ends of a portable computer 100. A similar antenna system 101 employing dual-monopole antennas could also be used with cellular telephones, 2-way pagers, and wireless LANs (not shown).

Figure 2:
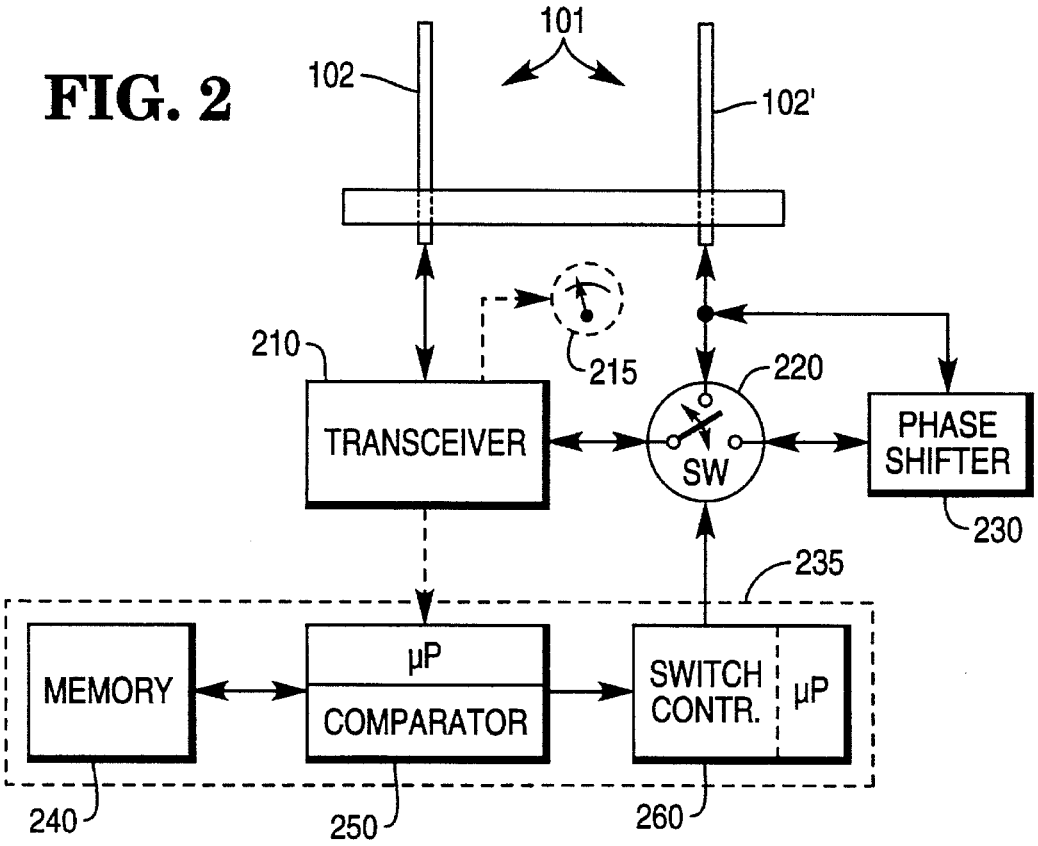
FIG. 2 is hardware block diagram illustrating one exemplary embodiment of the present system.

FIG. 2 is hardware block diagram illustrating two possible embodiments of a dual-monopole version of the present system. As shown in FIG. 2, antenna system 101 comprises two monopole elements 102, 102'. Antenna element 102 is connected to transceiver 210, and antenna element 102' is connected to both switch 220 and phase shifter 230. In the simpler of the two embodiments, optional comparator block 235 is not used, and a manual switch 220 is used to select alternative antenna patterns by switching phase shifter 230 either in series with transceiver 210 or switching the phase shifter 230 out of the circuit. A transceiver operator may toggle switch 220 to achieve the maximum audio volume, in the case of a cellular phone, for example. Optionally, an operator may toggle switch 220 by referring to a signal strength meter 215 to adapt the antenna to the superior configuration, where a non-audio cellular device is used.

Figure 3:
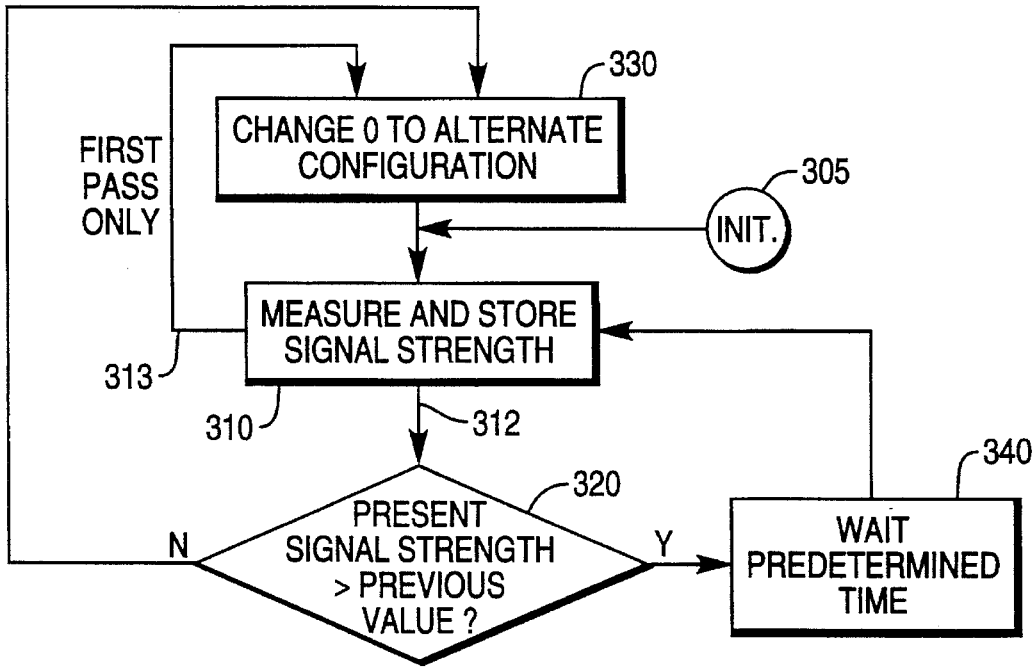
FIG. 3 is a flowchart illustrating one method used for adapting the system antenna configuration.

FIG. 3 is a flowchart illustrating one method used for adapting the system antenna configuration between alternative antenna patterns. FIGS. 6 and 7 illustrate overhead views of alternate antenna patterns to which the present embodiment of the system may be adapted. The second of the two embodiments shown in FIG. 2 is best described with reference also to FIGS. 3, 6, and 7. In this embodiment, comparator block 235 comprises is a signal strength comparator 250 connected between a memory device 240 and a switch controller 260. In operation, at step 305, comparator 250 initially instructs switch controller 260 to set switch 220 in a position which removes phase shifter 230 from the circuit. Antenna elements 102, 102' are thus in phase, and an antenna pattern similar to that shown in FIG. 6 is generated. At step 310, comparator 250 measures the signal strength of the signal received from the transmitting base station. Comparator 250 may be controlled either by a microprocessor, or by firmware or hardware. Switch controller 260 may optionally be microprocessor or firmware/hardware controlled, and may also provide system control in lieu of comparator 250. At step 310, comparator 250 receives a sample of the received signal and stores a value representing the signal strength thereof in memory device 240. On the initial pass through the flowchart, path 313 is taken, which loops back to step 330.

At step 330, comparator 250 instructs switch controller 260 to set switch 220 in a position which connects phase shifter 230 back into the circuit, between antenna element 102' and transceiver 210. Antenna elements 102, 102' are now out of phase, and an antenna pattern similar to that shown in FIG. 7 is generated. The phase shift imparted by phase shifter 230 is approximately 180 degrees to provide an antenna pattern having lobes which are oriented 90 degrees relative to the in-phase antenna pattern. At step 310, comparator 250 again measures the signal strength of the signal received from the transmitting base station. At this point, and in all subsequent passes through the flowchart, path 312 is taken to step 320. At step 320, comparator 250 compares the strength of the present received signal with the value of the previous signal stored in memory 240. If the present signal strength is greater than the stored value, then the presently selected antenna pattern is the desired one, and the system waits a predetermined time, at step 340, before again determining which antenna configuration is to be selected.

If, however, the present signal strength is not greater than the previously stored value, then, at step 330, comparator 250 instructs switch controller 260 to set switch 220 in a position which connects phase shifter 230 back to the alternate position, causing the alternative antenna pattern to be generated. In this case, after comparator 250 executes is steps 310 and 320, a branch will be taken to step 340, where the system waits a predetermined time before again determining which antenna configuration is to be selected. Therefore, a cellular communications transceiver operating in accordance with the present invention scans for the direction of signals transmitted from a base station and selects the transceiver antenna pattern which more efficiently receives and radiates RF energy in the general direction of the base station.

Figure 4:
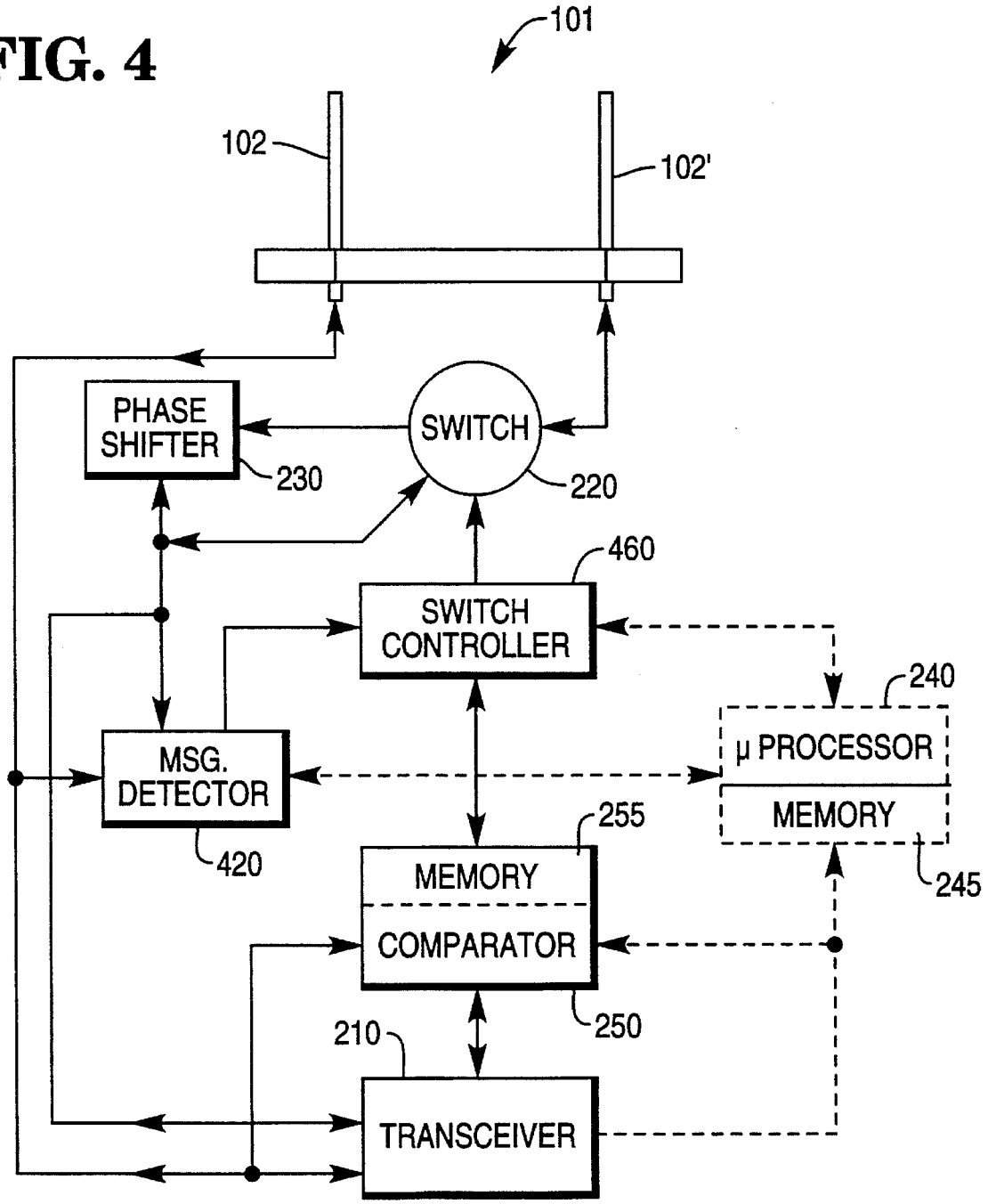
FIG. 4 is hardware block diagram illustrating two further alternative embodiments.

FIG. 4 is hardware block diagram illustrating two further alternative embodiments of the present cellular transceiver system, both of which utilize detection of a particular "message" from the base station. In the first of these embodiments, the mobile transceiver attempts to adapt the antenna configuration when a handoff message is detected by the transceiver electronics. In the second embodiment, two messages are sent from the base station to the mobile transceiver to allow the transceiver to determine the more advantageous direction in which to direct the antenna.

Handoff Message

In normal operation of a typical cellular phone system, only a single base station is within receiving range of the cellular transceiver. However, when the cellular phone approaches the boundary of a cell, at least two base stations will be within range. In a typical cellular phone system, a handoff protocol is used to transmit a handoff message to a succeeding said base station in an adjacent cell when the signal from said transceiver is stronger in the adjacent cell than in the cell presently communicating with the transceiver. In the present case, wherein a cellular phone system is used with an adaptive antenna, the transceiver antenna direction may need to be changed when the handoff is made, so that the transceiver antenna pattern is directed toward the new base station. In a further alternative embodiment of the present system, this is accomplished by the cellular transceiver which monitors the inter-cell handoff communications. The transceiver attempts to adapt the antenna configuration whenever a handoff is detected. This method is "passive" insofar as the base station is concerned, as there is no special adaptive antenna communications protocol directed to the mobile transceiver.

As shown in FIG. 4, a message detection circuit 420 is coupled to an adaptive antenna system similar to that described with respect to FIGS. 2 and 3. The principle of antenna configuration adaptation of the system shown in FIG. 4 is essentially the same as that shown in FIG. 2, therefore, only the different operational particularities of the present embodiment are described in detail here. It should be noted that microprocessor/memory circuit 240/245 is optional if comparator 250 or switch controller 460 has internal firmware (or an internal microprocessor) and memory sufficient to control system operation. If microprocessor 240 is present, then it is connected to message detection circuit 420, as well as comparator 250 and switch controller 460.

In operation, message detection circuit 420 receives signals from both antenna elements 102 and 102'. Signals received from element 102' pass through switch 220, which either directs the signals through phase shifter 230, or allows the signals to pass directly to message detection circuit 420, in which case the signals are in phase with those from antenna element 102. In the present embodiment, an initial signal strength value is stored either in optional comparator memory 255, or in microprocessor memory 245, if a separate microprocessor is employed. This signal strength value represents the signal strength of the transmission received from the presently transmitting base station using the existing transceiver antenna configuration. When an inter-cell handoff message is received by the transceiver, message detection circuit 420 causes switch controller 460 to toggle switch 220 which, in turn, causes antenna 101 to generate an alternate antenna pattern. Comparator 250 then compares the present signal strength with the value stored for the previous antenna configuration. If the present antenna pattern results in a stronger received signal than the previous pattern, then the antenna configuration remains fixed until the next handoff is detected. If, however, the present antenna pattern results in a weaker received signal than the previous pattern, then comparator 250 instructs switch controller 460 to switch the present antenna configuration back to the previous configuration until the next handoff is detected.

It should be noted that if microprocessor 240 is used, then message detection circuit 420 communicates via the microprocessor to the switch controller 460, and comparator 250 uses microprocessor memory 245 to store the signal strength values.

Adaptation Message

During periods wherein there is no transmission from the base station, a special protocol may be required to allow the transceiver antenna to adapt to the preferable configuration. In a further alternative embodiment of the present invention, an "adaptation message" from the base station is repeated twice in a predetermined time interval so that the cellular phone receives the message with the antenna aiming in each of the two directions. The antenna is then set to provide maximum directionality in the direction of the strongest signal from the base station. Unlike the handoff protocol detection described above, this method requires an additional component of the base station protocol specifically directed to the mobile transceiver. This method is useful for providing antenna direction orientation when the base station is not otherwise transmitting a signal on which the mobile transceiver can "home in".

The principle of operation of the "adaptation message" embodiment is similar to that of the "handoff message" embodiment described above, therefore, only the different operational particularities of the present embodiment are described in detail. As shown in FIG. 4, the present system utilizes message detection circuit 420 to detect the occurrence of an adaptation message transmitted from a base station. In operation, when an adaptation message is received by the transceiver, a signal strength value is stored either in optional comparator memory 255, or in microprocessor memory 245, if a separate microprocessor is employed. This signal strength value represents the signal strength of the transmission received from the presently transmitting base station using the existing transceiver antenna configuration. Immediately thereafter, message detection circuit 420 causes switch controller 460 to toggle switch 220 which, in turn, causes antenna system 101 to exhibit an alternate antenna pattern. When the second adaptation message is detected, comparator 250 compares the present signal strength with the value stored for the previous antenna configuration. If the present antenna pattern results in a stronger received signal than the previous pattern, then the antenna configuration remains fixed until the next adaptation message is detected. If, however, the present antenna pattern results in a weaker received signal than the previous pattern, then comparator 250 signals switch controller 460 to switch the present antenna configuration back to the previous configuration until the next adaptation message is detected.

Dual RF Front Ends

Figure 5:
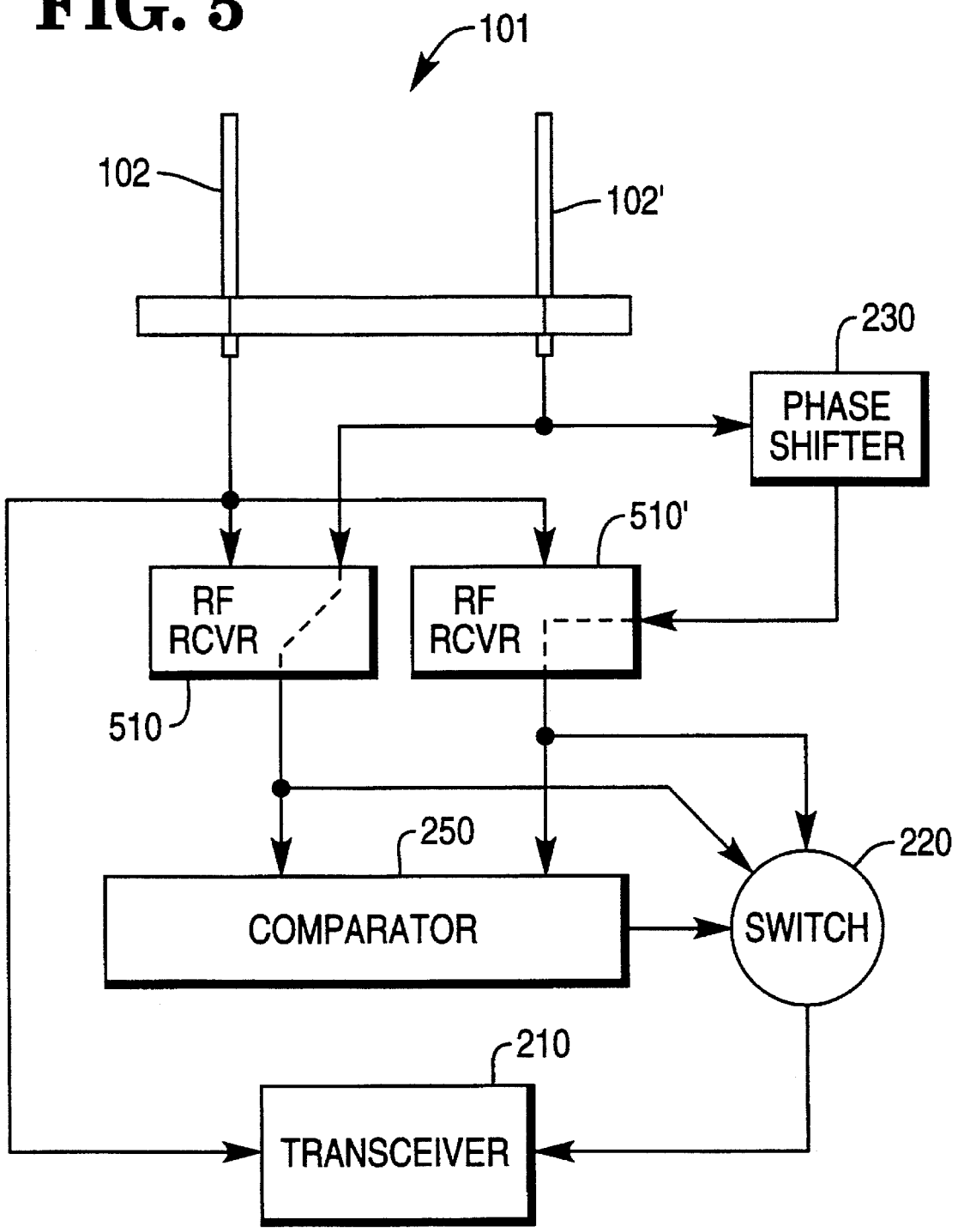
FIG. 5 is a hardware block diagram of an embodiment employing two RF front ends.

FIG. 5 is a hardware block diagram of an embodiment employing two RF front end receivers ("front ends") 510, 510'. As shown in FIG. 5, phase shifter 230 in hard-wired into the system to provide a fixed phase difference, typically 180 degrees, between the signals input to, and output from, the front ends 510, 510'. In operation, the signals from antenna elements 102, 102' are processed by front ends 510, 510', respectively, at the same time. In this case no special protocol or message is required, as comparator 250 measures the signal strength from both antenna configurations and instructs switch 220 to select the configuration providing the stronger signal, which is applied to transceiver 210. Alternatively, two (or more) different antennas with fixed patterns could be used, each pointing in a different direction.

Antenna Patterns

There are many directional antenna designs whose radiation patterns can be adapted by changing the phase of the feed signals to different antenna elements. Because space is limited in mobile computing devices, the antenna may be limited to 2 or 3 elements (for instance, two monopoles mounted on the ends of a portable computer). Because wide antenna pattern lobes are desirable, a simple adaptive antenna having two monopole elements is well suited to this application. FIGS. 6 and 7 show a pair of corresponding antenna patterns obtained by changing the phase of the signals transmitted or received by the two monopole antenna elements.

FIG. 6 is an overhead view of an antenna system having monopole elements 602, 602' separated by spacing SP1, which is preferably one-half wavelength of the transmitted/received signal. It can be seen that lobes 610, 610' are oriented along an East/West (E/W) axis, and nulls N1, N2 are oriented along a North/South (N/S) axis. This antenna pattern is generated when the signals received by or applied to elements 602 and 602' are in phase with each other.

FIG. 7 is an overhead view of the antenna system shown in FIG. 6. It can be seen that lobes 610, 610' are oriented along the N/S axis, and nulls N3, N4 are oriented along the E/W axis. This antenna pattern is generated when the signals received by or applied to elements 602 and 602' are 180 degrees out-of-phase with each other. The antenna system depicted in FIGS. 6 and 7 is essentially "bi-directional".

Regardless of whether a dual monopole or dual dipole antenna system is employed, the antenna pattern is chosen which maximizes return signal from the base station with which the portable device is communicating. This signal maximization is accomplished by using each of the available antenna patterns and measuring the amount of signal power received at the cellular phone from the base station for each antenna pattern configuration.

FIG. 8 is an overhead view of an antenna pattern realizable by using a pair of dipole elements. The cardioid antenna pattern thus generated is typically more directional than the pattern generated by a monopole element pair such as illustrated in FIGS. 6–7. As shown in FIG. 8, dipole elements 802, 802' are separated by a spacing SP2, which is typically ¼ wavelength. When an in-phase signal is applied to elements 802 and 802', the resultant cardioid pattern 810 is generated. When the applied signal is 90 degrees out-of-phase, for example, the antenna pattern shown in FIG. 8 is generated. As the relative phase between the dipole elements is changed, the direction of the main lobe 810 exhibits a corresponding rotational displacement about point C. As can be seen from FIG. 8, such a cardioid antenna pattern is substantially unidirectional, with a main lobe 810 in direction N in this case. In an alternative embodiment, Elements 802 and 802' could be monopoles, instead of dipoles. In a further alternative embodiment, regardless of whether antenna elements 802, 802' are monopoles or dipoles, an alternative antenna pattern could be selected wherein a null is directed toward the user of the transceiver, so as to minimize the radiated RF energy in the direction of the user.

It should be noted that the present method is functional with any number of monopole or dipole elements whose spacing and phase relationship permits generation of more than two alternative configurations. For example, a plurality of antenna patterns can consist of n antenna patterns where each of the antenna patterns consists substantially of a unidirectional lobe; the lobe in each of the antenna patterns is oriented approximately 360/n degrees to an adjacent lobe; and each of the antenna patterns is generated by establishing an appropriate phase relationship between the monopole antennas.

It is to be expressly understood that the claimed invention is not to be limited to the description of the preferred embodiment but encompasses other modifications and alterations within the scope and spirit of the inventive concept.

I claim:

1. A directionally adaptive antenna system for use with a portable communications transceiver for communicating with a base station in a communications network, said system comprising:

(a) at least two antennae, connected to said transceiver, for receiving a first signal from said base station;

(b) circuitry coupled to one of said antennae to enable said antennae to generate together a plurality of antenna patterns having mutually exclusive directionality;

(c) a switch, operable with said transceiver, for selecting one of said plurality of antenna patterns which provides a maximum signal strength of said first signal received from said base station; and (d) a switch operator for operating the switch to select the one of said plurality of antenna patterns, wherein said switch operator operates the switch to periodically select each of said antenna patterns to determine which one of said antenna patterns provides said maximum signal strength of said first signal received from said base station.

2. The antenna system of claim 1, wherein said switch operator provides a signal to an operator to manually operate the switch.

3. The antenna system of claim 1, wherein said switch operator operates the switch to periodically select each of said antenna patterns to determine which one of said antenna patterns provides said maximum signal strength of said first signal received from said base station.

4. The antenna system of claim 1, wherein each of said antenna patterns consists substantially of a unidirectional lobe.

5. The antenna system of claim 1, wherein each of said antenna patterns is bidirectional and consists substantially of two opposingly situated lobes.

6. The antenna system of claim 1, wherein a second signal is transmitted via the one of said antenna patterns used to receive a most recent said first signal.

7. The antenna system of claim 1, wherein said antennae are two monopole antennae, and wherein said circuitry includes a phase shift circuit operable with said switch for establishing a desired signal phase relationship between the two monopole antennae to generate a desired one of said antenna patterns.

8. The antenna system of claim 7, wherein said antenna patterns consist of two antenna patterns wherein:

each of said antenna patterns is bidirectional and consists substantially of two opposingly situated lobes;

each of said antenna patterns is oriented approximately 90 degrees to each other;

a first one of said antenna patterns is generated by establishing a first said phase relationship of 0 degrees; and a second one of said antenna patterns is generated by establishing a second said phase relationship of 180 degrees.

9. The antenna system of claim 1, wherein said antennae comprise more than two monopole antennae, and wherein said circuitry includes a phase shift circuit operable with said switch for establishing a desired signal phase relationship between the monopole antennas.

10. The antenna system of claim 9, wherein said plurality of antenna patterns consists of n said antenna patterns wherein:

each of said antenna patterns consists substantially of a unidirectional lobe;

said lobe in each of said antenna patterns is oriented approximately 360/n degrees to an adjacent said lobe; and each of said antenna patterns is generated by establishing an appropriate phase relationship between the monopole antennas.

11. The antenna system of claim 10, wherein each of said antenna patterns comprises a cardiocid pattern.

12. The antenna system of claim 1, wherein said base station periodically transmits a locator message pair consisting of a first instance of a locating message followed by a second instance of said locating message, and wherein said system further comprises:

(a) memory for storing a signal strength value; and (b) a detector circuit, connected to said antennae, said switch operator and said switch for:

(1) detecting said first instance of said locating message;

(2) storing a value representing the signal strength of said first instance in said memory; and (3) causing said switch to select an alternate one of said antenna patterns in response to detection of said first locating message; and (4) detecting said second instance of said locating message; and wherein said switch operator includes a comparator, connected to said antenna and operable with said switch, for:

(1) comparing said value stored in said memory with the signal strength of said second instance; and (2 ) causing said switch to select one of the antenna patterns which provides a greater signal strength of said locating message.

13. The antenna system of claim 1, wherein said base station is located in a first cell of a cellular communications network, and wherein a handoff protocol is used to transmit a handoff message to a succeeding base station in a second cell when a second signal from said transceiver is stronger in said second cell than in said first cell, said system further including:

(a) memory for storing a signal strength value; and (b) a detector circuit, connected to said antennae, said switch operator and said switch for:

(1) detecting said handoff message;

(2) storing a value representing the signal strength of said first signal in said memory; and (3) causing said switch to select an alternate one of said antenna patterns in response to said detecting; and wherein said switch operator includes (c) a comparator for:

(1) comparing said value stored in said memory with the signal strength of said first signal received by said alternate one of said antenna patterns; and (2) causing said switch to select one of the antenna patterns which provides greater signal strength of said first signal.

14. The antenna system of claim 1, wherein said antennae comprises two monopole antennae having a first configuration in which a first phase relationship exists between said monopole antennae, said switch operator includes a comparator for determining a relative signal strength of two signals; and said antenna system further includes two RF receivers, each of which is connected between a different one of each of said antennae and said comparator;

wherein said comparator is operative with said switch to connect said transceiver to a configuration which provides a stronger said relative signal strength.

15. A directionally adaptive antenna system for use with a portable communications transceiver for communicating with a base station in a communications network, said system comprising:

(a) antenna means comprising at least two monopole elements for receiving a first signal from said base station and transmitting a second signal to said base station, said antenna means connected to said transceiver;

wherein said antenna means is adaptable to generate together a plurality of antenna patterns having mutually exclusive directionality;

(b) comparator means, connected to said antenna means, for determining an optimum one of said antenna patterns which provides a maximum signal strength of said first signal received from said base station;

(c) phase shift means, connected to said antenna means, for establishing a desired signal phase relationship between each of said monopole elements; and (d) switch means, responsive to said comparator means and operable with said phase shift means, for selecting one of said antenna patterns which provides the maximum signal strength of said first signal received from said base station.

16. The antenna system of claim 15, wherein said switch means periodically selects each of said antenna patterns to determine which one of said antenna patterns provides said maximum signal strength of said first signal received from said base station.

17. The antenna system of claim 15, wherein said second signal is transmitted via a one of said antenna patterns used to receive a most recent said first signal.

18. The antenna system of claim 15, wherein said plurality of antenna patterns consists of two antenna patterns and wherein:

each of said antenna patterns is bidirectional and consists substantially of two opposingly situated lobes;

each of said antenna patterns is oriented approximately 90 degrees to each other;

a first one of said antenna patterns is generated by establishing a first said phase relationship of 0 degrees; and a second one of said antenna patterns is generated by establishing a second said phase relationship of 180 degrees.

19. The antenna system of claim 15, wherein said plurality of antenna patterns consists of n said antenna patterns wherein:

each of said antenna patterns consists substantially of a unidirectional lobe;

said lobe in each of said antenna patterns is oriented approximately 360/n degrees to an adjacent said lobe; and each of said antenna patterns is generated by establishing an appropriate phase relationship between the monopole elements.

20. The antenna system of claim 15, wherein said base station periodically transmits a locator message pair consisting of a first instance of a locating message followed by a second instance of said locating message, and wherein said system further comprises:

(a) memory for storing a signal strength value;

(b) detection means, interconnected between said antenna means and said switch means for:

(1) detecting said first instance of said locating message;

(2) storing a value representing the signal strength of said first instance in said memory;

(3) causing said switch means to select an alternate one of said antenna patterns in response to detection of said first locating message; and (4) detecting said second instance of said locating message;

wherein said comparator means:

(1) compares said value stored in said memory with the signal strength of said second instance, and (2) causes said switch means to select one of The antenna patterns which provides greater signal strength of said locating message.

21. The antenna system of claim 15, wherein said base station is located in a first cell of a cellular communications network, and wherein a handoff protocol is used to transmit a handoff message to a succeeding base station in a second cell when said second signal from said transceiver is stronger in said second cell than in said first cell, said system further including:

(a) memory for storing a signal strength value;

(b) detection means, interconnected between said antenna means and said switch means for:

(1) detecting said handoff message;

(2) storing a value representing a signal strength of said first signal in said memory; and (3) causing said switch means to select an alternate one of said antenna patterns in response to said detecting; wherein said comparator means:

(1) compares said value stored in said memory with a signal strength of said first signal received by said alternate one of said antenna patterns; and (2) causes said switch means to select one of the antenna patterns which provides a greater signal strength of said first signal.

22. The antenna system of claim 15, wherein said antenna means comprises two monopole elements having a first configuration in which a first phase relationship exists between said monopole elements wherein (a) said phase shift means establishes a second configuration in which a second phase relationship exists between said monopole elements;

(b) said comparator means determines a relative signal strength of two signals each provided by a respective one of said configuration; and said antenna system further comprising:

two RF receivers, each of which is connected between a different one of each of said elements and said comparator means;

wherein said comparator means is operative with said switch means to connect said transceiver to the configuration which provides a stronger said relative signal strength.

23. A method for directionally adapting an antenna system for use with a portable communications transceiver for communicating with a base station in a communications network, said method comprising the steps of:

(a) receiving, via an antenna having at least two monopole elements, a first signal from said base station;

(b) determining an optimum antenna pattern from a plurality of antenna patterns which provides a maximum signal strength of said first signal received from said base station; and (c) establishing a desired signal phase relationship between each of said monopole elements to generate said optimum antenna pattern.

24. The method of claim 23, including the step of periodically selecting each of said plurality of antenna patterns to determine which of said plurality of antenna patterns provides said maximum signal strength of said first signal received from said base station.

25. The method of claim 23, wherein said base station periodically transmits a locator message pair consisting of a first instance of a locating message followed by a second instance of said locating message, including the steps of:

(a) periodically receiving, from said base station, a locator message pair consisting of a first instance of a locating message followed by a second instance of said locating message; and performing, at a transceiver site, the steps of:

(b) detecting said first instance of said locating message corresponding to an antenna pattern;

(c) storing a value representing a signal strength of said first instance in memory;

(d) selecting an alternate antenna pattern in response to detection of said first locating message;

(e) detecting said second instance of said locating message corresponding to the alternate antenna pattern;

(f) comparing said value stored in said memory with a signal strength of said second instance, and (g) selecting one of the antenna patterns which provides a greater signal strength of said locating message.

26. The method of claim 23, wherein said base station is located in a first cell of a cellular communications system, and wherein a handoff protocol is used to transmit a handoff message to a succeeding base station in a second cell when a second signal from said transceiver is stronger in said second cell than in said first cell, said method further including the steps of:

(a) detecting said handoff message;

(b) storing a value representing a signal strength of said first signal in memory that corresponds to an antenna pattern;

(c) selecting an alternate antenna pattern in response to said detecting;

(d) comparing said value stored in said memory with a signal strength of said first signal received by said alternate antenna pattern; and (e) selecting one of the antenna patterns which provides a greater signal strength of said first signal.

* * * * *